US006498430B1

(12) United States Patent
Sakai et al.

(10) Patent No.: US 6,498,430 B1
(45) Date of Patent: Dec. 24, 2002

(54) PLASMA DISPLAY DEVICE

(75) Inventors: Hisamitsu Sakai, Yokaichi; Masashi Kato, Kokubu; Tetsuya Maeda, Yokaichi; Kazuo Watada, Yokaichi; Junji Hatanaka, Yokaichi, all of (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/258,646

(22) Filed: Feb. 26, 1999

(30) Foreign Application Priority Data

Feb. 27, 1998 (JP) ..... 10-048033

(51) Int. Cl.[7] ..... H01J 17/49

(52) U.S. Cl. ..... 313/582; 313/583; 313/4; 313/5

(58) Field of Search ..... 313/582, 583, 313/4, 5, 6, 422

(56) References Cited

U.S. PATENT DOCUMENTS 4,220,892 A * 9/1980 van Raalte ..... 313/422
5,565,742 A * 10/1996 Shichao et al. ..... 313/257
6,088,011 A * 7/2000 Lee et al. ..... 345/60

FOREIGN PATENT DOCUMENTS

JP 02223132 9/1990 ..... H01J/17/16
JP 08190869 7/1996 ..... H01J/17/49
JP 10247458 9/1998 ..... H01J/17/49
WO WO9711477 3/1997 ..... H01J/17/49

* cited by examiner

*Primary Examiner*—Frank G. Font
*Assistant Examiner*—Roy M. Punnoose
(74) *Attorney, Agent, or Firm*—Hogan & Hartson, L.L.P.

(57) ABSTRACT

In a plasma display device comprising a pair of opposing insulating substrates and a plurality of light emitting cells 5 formed from partition walls which divide the space between the insulating substrates while a plurality of electrodes are formed in the light emitting cells 5 and the inner space is filled with a discharge gas and plasma being generated by applying a voltage selectively between the electrodes so that the fluorescent substances 4 formed on the inner walls of the light emitting cells emit light as light emitting elements, wherein sizes of the light emitting cells 5 of different colors are made different according to the luminance of the fluorescent substance of the corresponding color. That is, cells which emit light of a color of luminance lower than the other cells are made with larger opening to obtain equally high luminance for all the three primary colors, thereby mitigating the deviation in the luminance among the fluorescent substances and achieving full-color display of high image quality with high color purity.

7 Claims, 5 Drawing Sheets

PLASMA DISPLAY DEVICE

FIELD OF THE INVENTION

The present invention relates to a plasma display device used for colored image display of high brightness having low weight and thin construction.

PRIOR ART

Cathode ray tubes, which have been widely used as image display apparatuses, have bulky construction with large weight and requirements for high supply voltage, and therefore have been replaced by flat panel-shaped image display apparatus such as plasma display device (also referred to as a plasma display panel). The plasma display devices have been developed as the multimedia and telecommunication technologies advance and have been finding new, expanding applications.

The plasma display device is considered to be a promising colored image display apparatus in the future, because it has high image quality achieved by the use of plasma light emission, availability for large screen size and thin and low weight construction without occupying much place to be installed.

A plasma display device, as shown in FIG. 4, has such a construction that a space between a back plate 1, which is a substrate, and a transparent front plate 6 disposed in front of the back plate 1 is divided by plurality of partition walls 2, then to form plurality of light emitting micro-cells 5 surrounded by the partition walls. Each cell includes a pair of discharge electrodes 7 and 7, fluorescent layer 4 applied to the inner wall surfaces within the cell to emit one of the three primary colors, and a rare gas filling the inner space.

An address electrode 3 for switching light emission is placed at the bottom of the cell, and a voltage is applied selectively between the address electrode 3 and the discharge electrode 7, thereby discharging the rare gas to generate plasma. Ultraviolet light emitted by the discharge of the rare gas induces the emission of fluorescent light of wavelengths intrinsic to the fluorescent substances of the fluorescent layer 4 applied to the inner wall of the light emitting cell 5. Such cells constitute as light emitting elements an image for the display apparatus.

The color plasma display device uses emission of light in three primary colors, red (R), green (G) and blue (B) from the different fluorescent substances 4 excited by vacuum ultraviolet rays of the plasma. More particularly, energy released from the rare gas excited by the plasma in the cells, when returning to the ground state, is emitted as vacuum ultraviolet rays, which are used to excite the fluorescent substances 4 and to emit fluorescent light due to a change in energy level of the fluorescent substance from the excited state to the ground state. Red (R), green (G) and blue (B) colors are generated by using light of wavelengths intrinsic to the three different fluorescent substances.

The fluorescent substances which emit different colors receive the supplied energy in the form of the same ultraviolet ray and convert the energies into light of different wavelengths. As a result, the light of different colors have different values of spectral luminous efficacy dependently on the light wavelength, i.e., the color, and, therefore, luminous flux from the light emitting cells varies depending on the color of the cell. Different fluorescent substances also have different luminous efficacy, namely dependency of radiated energy on the electric power supply. Consequently, a simple colored image on the display panel has different value depending on the color, R, G or B.

Supposing, for example, blue light emitted by a fluorescent substance has lower luminance than green light by the another, an image on base of blue, for example color of sea, has different gradient from an image on base of green, for example, the color of forest. The green forest has higher luminance than the blue sea. As a result, gradation of display cannot be controlled smoothly for the image of sea having insufficient luminance, resulting in giving a grained impression of the blue sea to viewers. An image on base of red, for example, making up the color of a person's skin, has also been difficult to represent with smooth and natural texture for the same reason, because red color has an intermediate level of luminance between green and blue.

Difference in the luminance of fluorescent substances of different colors is a cause of variation in tonality of images displayed on the panel, and the plasma display devices of the prior art has such a problem that it is difficult to represent natural images.

SUMMARY OF THE INVENTION

An object of the present invention is to provide a plasma display device which is capable of producing different colors having uniform maximum luminance to display natural full-color images, by setting dimensions of light emitting cells of three colors RGB such that each fluorescent substance in the light emitting cell may emit substantially the same luminous flux of light.

According to the present invention, inner spaces of the light emitting cells of the plasma display device are formed in different sizes according to luminance of the color of each fluorescent substance.

In the present invention, each light emitting cell is to emit light different in color with less deviation in luminous flux between the color light emitting cells, thereby to obtain substantially equal levels of luminance with different colors on the image.

Specifically, among the fluorescent substances of red (R), green (G) and blue (B) colors, cell space for color B, if it has the lowest luminance of the all colors, is made greater, cell space for color G, having the highest level of luminance, is made smaller. Cell space for color R having an intermediate level of luminance is set to an intermediate size. This makes it possible to prevent the image displayed on the plasma display device from being yellowish as in prior art, and to provide more natural full-color display.

More specifically, luminance of light emitted.by a light emitting cell increases in near proportion to the cube of the size of opening of a light emitting cell. For example, when the opening area of the light emitting cell increases by 10%, luminance of light emitted from the cell increases by about 30%. The present invention makes use of this characteristic of light emitting cell to set said cells such that a product of the cube of the size of opening of the light emitting cell emitting one of primary colors multiplied by luminance of the color emitted by the fluorescent substance is substantially equal to that of any other primary color.

According to the present invention, space of the light emitting cell can be changed for different primary colors by forming the light emitting cells with different widths for different primary colors. Width of a light emitting cell can be changed by changing the pitch of partition walls having a constant thickness and/or the thickness of the partition wall having a constant pitch. Such a method may also be employed as the light emitting cells of different primary colors are made to have different depths. In the plasma display device of the present invention, deviation in luminous flux among R, G and B colors emitted by the light emitting cells is mitigated to make the luminances of different colors uniform over the entire display panel, thereby enhancing the displayed image quality.

According to the present invention, ratio of the thickness of each partition wall to the sum of widths of discharging regions located on both sides of the partition wall is preferably made substantially constant. This configuration makes it possible to make substantially equal stress applied to all partition walls regardless of different widths of a light emitting cell adjoining the partition wall (namely the interval between the partition walls). As a consequence, because the stress generated in the partition walls can be made constant even when the opening areas of the light emitting cells and the thickness of the partition walls experience variations because of adjustment of luminance of the three primary colors on the display panel, defects in the partition walls and coupling of the light emitting cells caused thereby can be prevented.

BRIEF DESCRIPTION OF THE DRAWINGS

The plasma display device of the present invention will now be described in detail below with reference to the accompanying drawings, in which.

EMBODIMENT OF THE INVENTION

Figure 1:
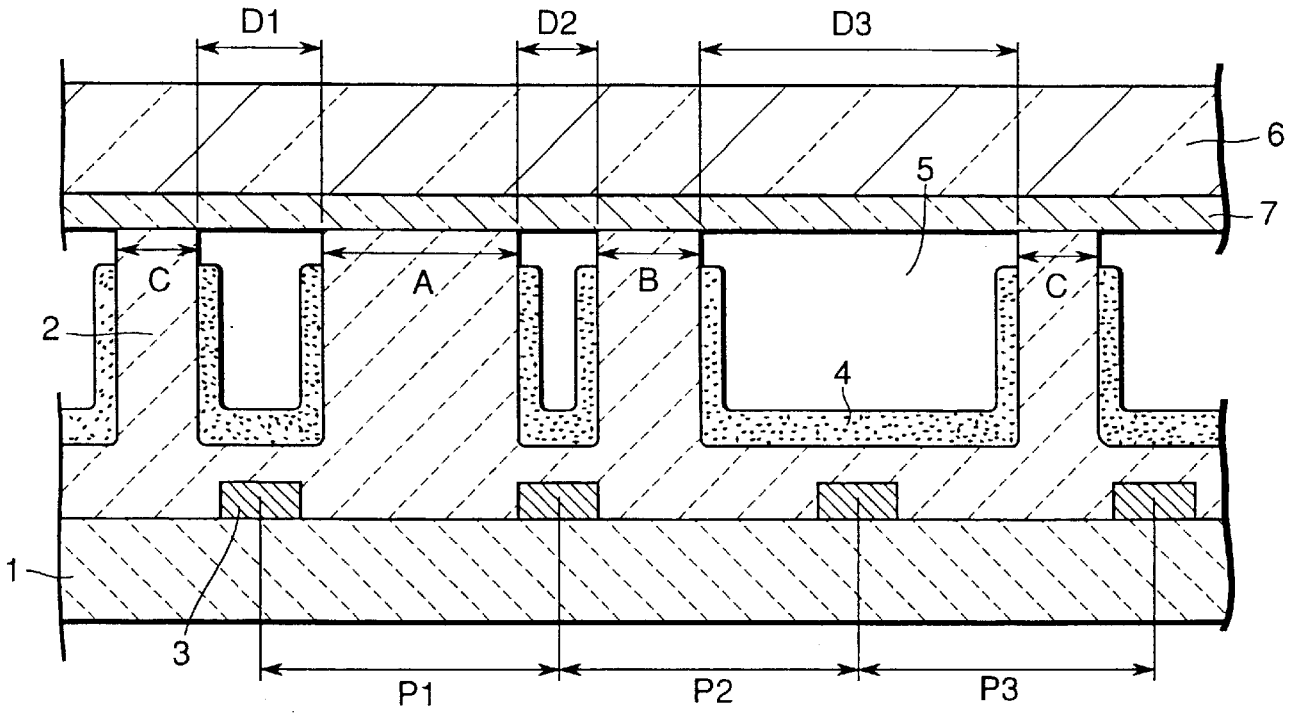
FIG. 1 is a partially sectional view showing a plasma display device according to an embodiment of the present invention.
Figure 2:
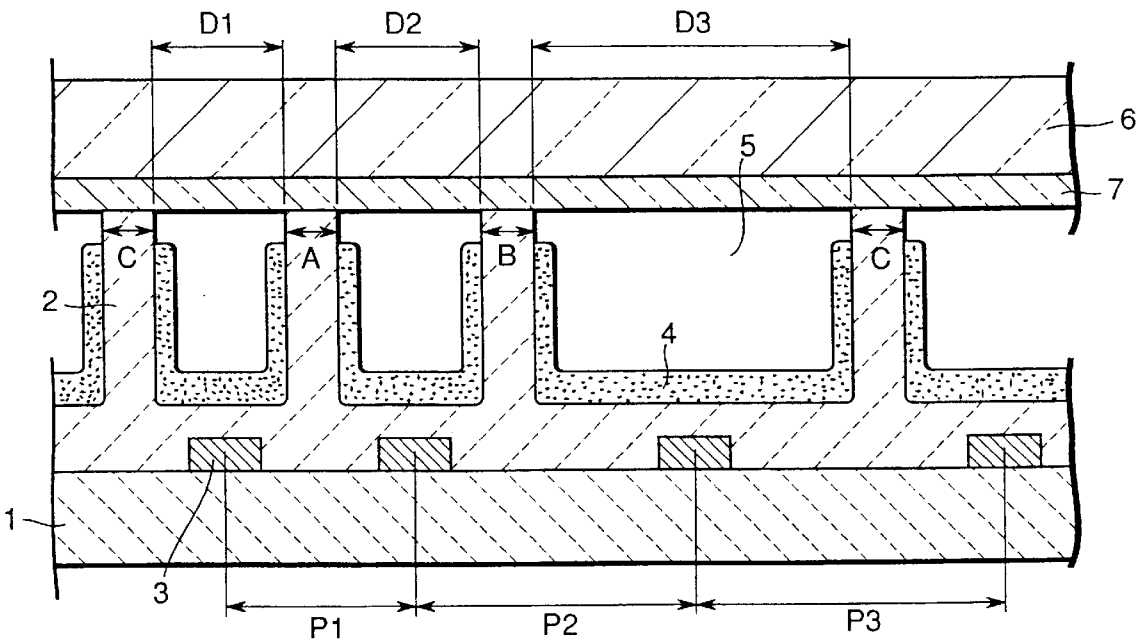
FIG. 2 is a partially sectional view showing another embodiment of the plasma display device of the present invention.

Referring to FIGS. 1 and 2, a plasma display device comprises a back substrate 1, a transparent front plate 6 opposing the substrate, and a plurality of partition walls 2 disposed in parallel in a space between the substrate and front plate, thereby forming a multitude of light emitting cells 5 in the space. Each cell 5 has a pair of discharge electrodes 7 formed on the front plate 6, and an address electrode 3 on the substrate, while the partition wall in the light emitting cell is applied with any one three kinds of fluorescent substance 4 which emit each light of three colors, R, G and B, the tree colors of light emitting cells being arranged alternatively to construct a color image panel.

In the plasma display device of the present invention, spaces of the light emitting cells 5 are made to have different sizes according to luminance of the fluorescent substance 4. Namely, space of a light emitting cell 5 having fluorescent substance of lower luminance is made larger.

According to the present invention, the light emitting cells are set so that a product of the cube of the size of opening of the light emitting cell of one of primary colors multiplied by luminance of light of the color emitted by the fluorescent substance is substantially equal to that of any other primary color. Preferably, ratio of the opening sizes of cells of different primary colors falls within a range from 0.9 to 1.1 times the 1/3 powers of the ratio of the values of luminance produced by the fluorescent substances of the respective colors. Luminance is determined separately for each of the three kinds of fluorescent substances 4, for R, G and B colors. Luminance of the color of each fluorescent substance may actually be measured using the panel of the plasma display device to be practically used, except for the size of the identical light emitting cells, then obtaining luminance of each single light from the panel which is prepared by applying a fluorescent substance of one color to all light emitting cells in the panel.

For the size of the light emitting cell opening of each primary color, ratio of the widths of the openings is changed. For this purpose, ratio of the partition wall pitch and/or ratio of thickness are set for the light emitting cell of each primary color.

Size of the light emitting cell of each primary color may also be set by changing the ratio of the cell depths.

The embodiment described below is an example of setting the size of the cell space by changing the width of the light emitting cell.

In this embodiment, it is assumed that blue fluorescent substance exhibits the lowest luminance, the red one, intermediate, and that the green one has the greatest luminance. Therefor, the width D2 of the green light emitting cell is set to be the smallest value, which cell is coated by the fluorescent substance of green (G) that has the highest level of luminance. And the width D3 of the blue light emitting cell is set to be the greatest value, which cell is coated by the fluorescent substance of blue (B) that has the lowest level of luminance. An intermediate value is set for the width D1 of the red light emitting cell 5 which is coated by the fluorescent substance of red (R) that has an intermediate level of luminance. This makes it possible to mitigate the deviation in the luminance of each light emitting cell 5.

According to the present invention, two different methods can be used to differentiate the widths of the light emitting cells of different colors as shown in FIG. 1 and FIG. 2.

The first method is to change the thickness A, B and C of the partition walls 2 which form the light emitting cells 5 with pitches P1, P2 and P3 of the cells 5 of different colors being identical. Thus widths D1, D2 and D3 of the light emitting cells, and consequently the opening areas, are changed.

Another method is to make thickness A, B and C of the partition walls 2 which form the light emitting cells 5 identical and change the pitches P1, P2 and P3 of the light emitting cells 5, thereby changing the widths D1, D2 and D3 of the light emitting cells, and consequently the opening areas. Or alternatively, both the thickness and pitch of the partition wall 2 may be changed.

As described above, optimum opening area can be obtained for the different fluorescent substances 4 of the light emitting cells 5 by changing the widths D1, D2 and D3 of the light emitting cells. As a consequence, luminous flux of every color from the light emitting cells 5 becomes constant, resulting in reduced deviation in luminance of different colors on the display image.

Figure 3:
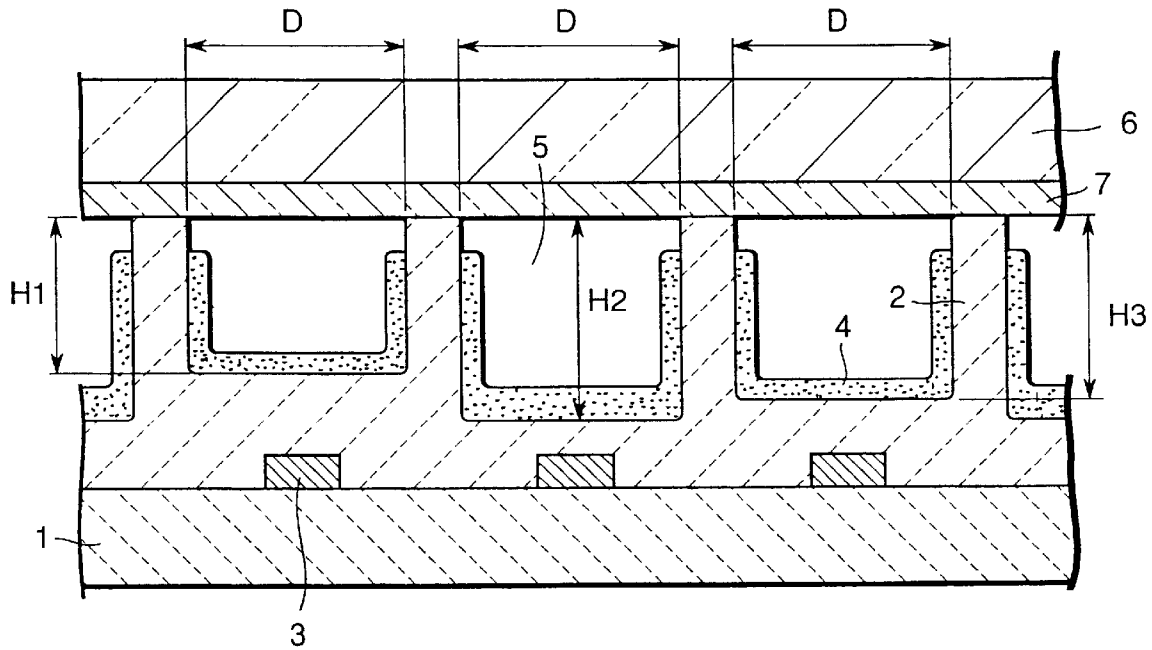
FIG. 3 is a partially sectional view showing another embodiment of the plasma display device of the present invention.
Figure 4:
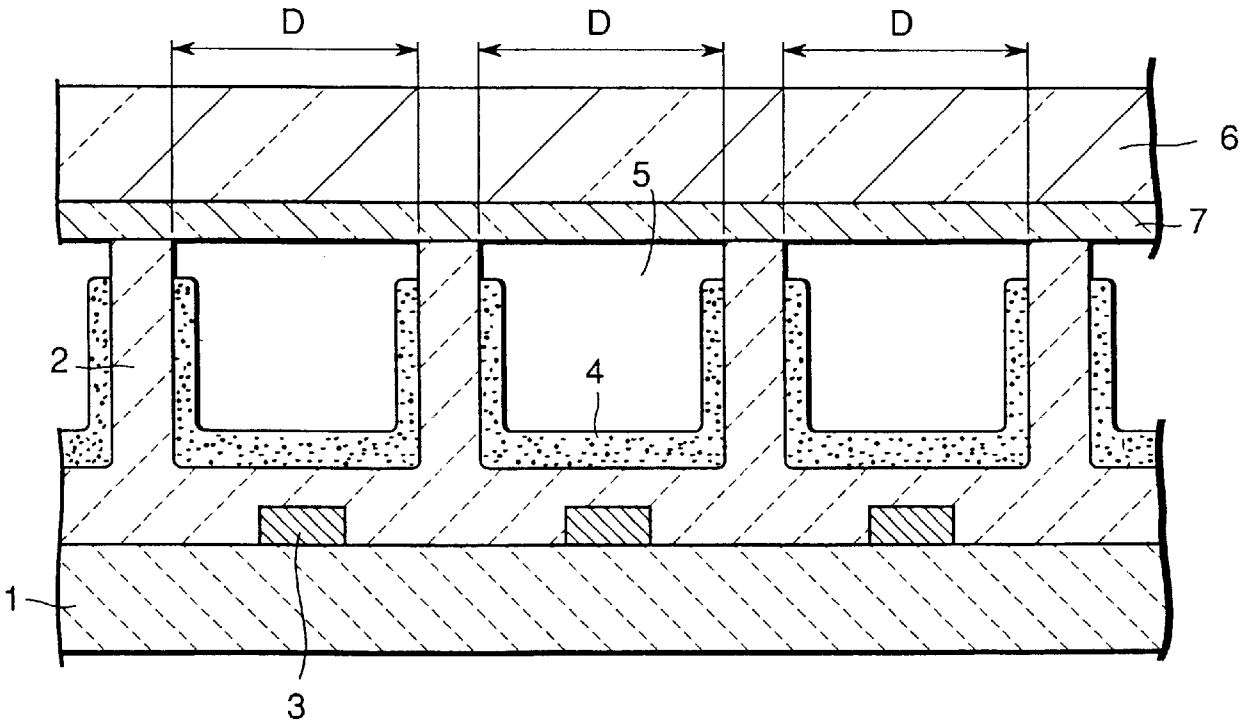
FIG. 4 is a partially sectional view showing a plasma display device of the prior art; and, FIG. 5 is a partially sectional view showing the plasma display device according to other embodiment of the present invention.

Widths of the light emitting cells 5 separated by the partition walls 2 are preferably adjusted within a range from 0.4D to 1.6D for the width D of the light emitting cell in the case of equally divided light emitting cells shown in FIG. 3. This range is set to obtain the ratio of opening area of the light emitting cells which is necessary and sufficient to achieve comparable luminance with blue (B) light which has the weakest luminance and green (G) light which has the highest luminance.

Luminous flux of the light emitting cell 5 is proportional to the size of the light emitting cell opening, namely the cube of the width thereof. Therefore, values of luminance of the individual fluorescent substances 4 of three kinds, R, G and B colors, are determined in advance, and the widths of the light emitting cells are determined so that the product of the luminance and the cube of the width of the light emitting cell is substantially the same among the light emitting cells of different colors.

In another embodiment of the present invention, size of the light emitting cell space can be changed by differentiating the depths H1, H2 and H3 of the light emitting cells 5. Also in this case, the light emitting cell of blue (B) light having weaker luminance can be made deeper and the light emitting cell of green light having stronger luminance can be made shallower.

In the plasma display device of the present invention, soda-lime glass or various ceramics can be used for the back plate 1. The partition wall 2 includes glass having a low melting point such as lead borosilicate glass. The address electrode 3 can be formed from an electrically conductive paste including Ag particles.

The light emitting cells are attached with layers of fluorescent substances 4 inside the walls. As a blue fluorescent substance, a mixture of $BaMgAl_{10}O_{17}$ to Eu Oxide may be used, as a green fluorescent, a mixture of (Ba,Sr,Mg)O-$aAl_2O_3$ to Mn Oxide, and as a red fluorescent a mixture of $(Y,Gd)BO_3$ to Mn oxide, respectively. The order of luminance values of these fluorescent substances may change by adapting the mixing ratios in the said mixtures.

While the transparent front plate 6 which is an insulating substrate on the display screen side is attached on the partition wall 2, inner surface of the front plate 6 is coated with a transparent discharge electrode 7 by vapor depositing indium oxide, tin oxide or the like.

Figure 5:
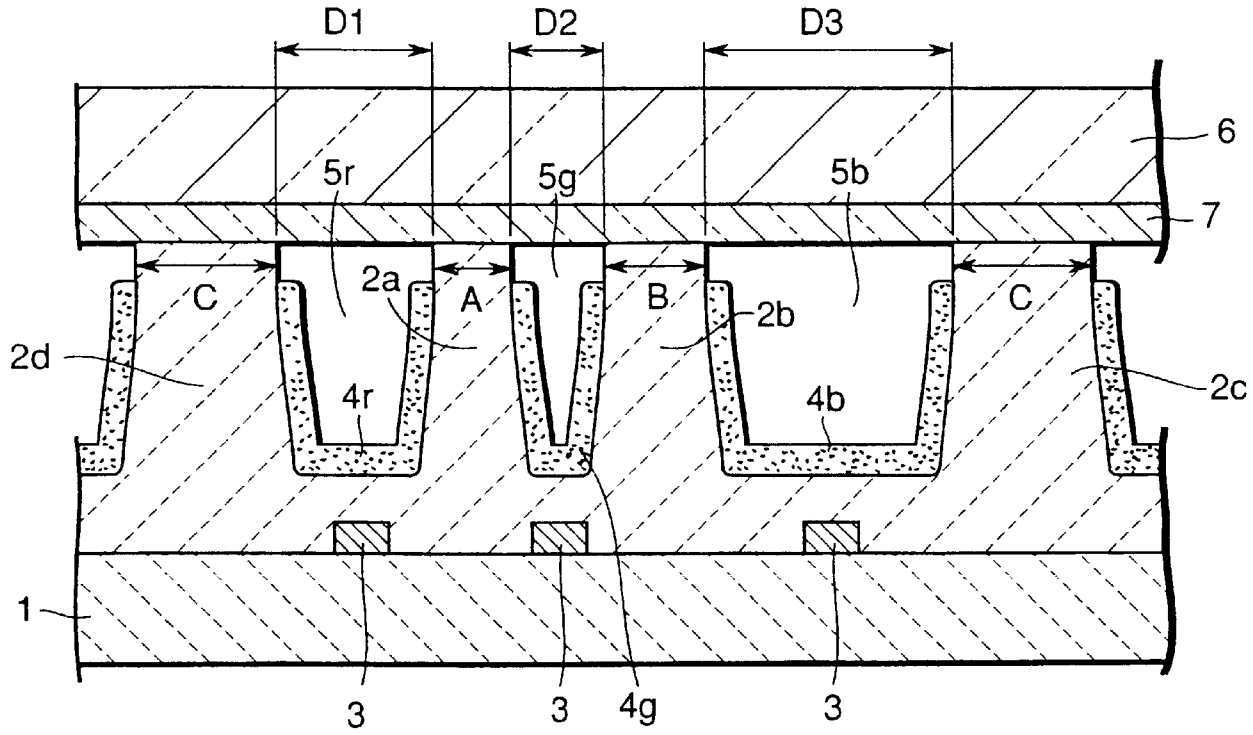

The partition wall is preferably configured so that ratio of the partition wall thickness to the sum of the widths of the discharge regions located on both sides of the partition wall is maintained substantially constant as shown in FIG. 5. In FIG. 5, thickness of the three kinds of partition walls 2*a*, 2*b* and 2*c* are denoted as A, B and C, respectively, width of the light emitting cell interposed between two partition walls 2*a* and 2*b* is denoted as D1, width of the light emitting cell interposed between two partition walls 2*b* and 2*c* is denoted as D2, and width of the light emitting cell interposed between two partition walls 2*c* and 2*a* is denoted as D3. When the following relations are assumed;

$$Ka=(D1+D2)/A;$$

$$Kb=(D2+D3)/B: \text{ and,}$$

$$Kc=(D3+D1)/C\ ,$$

then, the thickness of the partition walls 2*a*, 2*b* and 2*c* is set to satisfy the relationship Ka≈Kb≈Kc. With this configuration, in the event that a force is applied to act between the front plate 6 and the back plate 1, substantially uniform distribution of stress can be obtained in the partition walls 2*a*, 2*b* and 2*c* . This can reduce chances of the partition walls 2*a*, 2*b* and 2*c* to be damaged. The relationship Ka≈Kb≈Kc is preferably satisfied with a tolerance of ±10% of the values of Ka, Kb and Kc.

The method of producing the plasma display device of the present invention will be described below in detail.

First, the address electrode 3 is formed in advance on the surface of the back plate 1 as an insulating substrate. Then a paste which includes a binder and a constituent for forming the partition wall is applied to the back plate 1 to form a film with a predetermined thickness. The paste is applied onto the back plate 1 in a direction perpendicular to the address electrode 3 by roll coater method, doctor blade method, screen printing, gravure printing or the like. In the case where suitability for mass production is taken into consideration, doctor blade method is preferable to be adopted. For the binder used in forming the partition walls, a thermoplastic binder such as acrylic or butyral resin and reactive-curing resin such as photo-setting resin, particularly, ultraviolet-curing resin, and thermosetting resin may be used because of the capability to render the paste appropriate plasticity.

Then the coat formed on the back plate 1 is pressed by means of a die having the shape of the partition wall formed on one side thereof, thereby to form the consecutive partition walls in close contact with the back plate 1. The die is designed to have a transferring surface capable of precisely forming the partition wall 2 having the predetermined pitch or width, thus making it possible to easily form the partition walls 2 as described above.

Dies for forming the partition wall may be made of a metal, resin or rubber. A complex die may also be used, including a pattern transferring member made of resin or rubber attached only on some base metal. The die surface is subjected to surface treatment as required for improving the die release and wear resistance.

The die may also have embossed surface formed in the pattern of the partition walls, and a flat plate or a roll may be used. It is preferable, in consideration of the fabrication of the die, dimensional accuracy of the partition wall formation and the mass productivity, to use a roll die with partition wall forming grooves formed on the surface thereof and press the roll while rotating the roll and cause the paste layer to undergo plastic deformation.

When forming the partition walls 2, placing the back plate on a support member made of a metal, ceramic material, resin or rubber is effective in preventing the back plate from deforming and improving the dimensional accuracy of the formed body.

In the plasma display device of the present invention, sand blast process or the like may also be employed when forming the partition walls 2.

Also according to the present invention, a metal oxide which renders black color is added to the partition wall forming material, to give a function of black matrix to the partition walls thereby to achieve a high contrast of images.

EXAMPLE 1

First, the back plate 1 made of soda-lime glass measuring 2 mm in thickness and 30 inches in diagonal size was used. The back plate was coated over the entire surface thereof with an electrode paste including silver as a major component by thick film printing method in the form of stripes 90 μm in width with a pitch of 360 μm, followed by baking, thereby to form address electrodes 3.

The address electrodes 3 are aligned and the partition walls 2 measuring 25 μm in width and 150 μm in height are formed by pressing the die, dried and fired.

In the cases to be described below, first a monochromatic plasma display panel was produced. Only a past including a fluorescent substance, mixture of $(Y,Gd)BO_3$ to Mn oxide, for red color, was applied to all the light emitting cells on the back plate of the plasma panel by screen printing method, thereby to fire a red fluorescent substance layer 4. Then the front plate 6 with the discharge electrode 7 was integrated and filled with a rare gas, formed into a red plasma panel.

Similarly, a blue plasma display panel and a green plasma display device were made by using a blue fluorescent substance of a mixture of $BaMgAl_{10}O_{17}$ to Eu Oxide, and a green fluorescent substance, a mixture of (Ba,Sr,Mg) $OaAl_2O_3$ to Mn Oxide, respectively. Thus, the red, blue and green monochromatic plasma display panels were prepared for measuring each luminance.

The three panels were turned on under the same operating conditions with the same voltage applied across the electrodes, the average luminance was decided on the emitting surface of each panel. The resulting luminances were 550 cd/$m^2$ for the red panel, 1200 cd/$m^2$ with for green panel and 250 cd/$m^2$ for the blue panel.

These luminance values of the individual fluorescent substances were used to determine widths of the light emitting cells 5 of the fluorescent substances as 290 $\mu$m for D1 (red), 225 $\mu$m for D2 (green) and 380 $\mu$m for D3 (blue), on the ground that the products of the luminance of the individual fluorescent substance multiplied by the cube of the light emitting cell width are substantially equal for all the three colors. The light emitting cell width is the distance between top edges of the partition walls 2 which form the light emitting cell 5, but does not include the thickness of the partition wall 2

The die was designed using the calculated value of the light emitting cell width as the base, and the plasma display device shown in FIG. 1 was made. The back plate 1 made of soda-lime glass measuring 2 mm in thickness and 30 inches in diagonal size was coated over the entire surface thereof with an electrode paste including silver as a major component by thick film printing method in the form of stripes 90 $\mu$m in width with a pitch of 360 $\mu$m, followed by baking, thereby to form the address electrodes 3.

These electrodes were aligned to form the partition walls 2 of different thickness as shown in FIG. 1, with the cells having the values described above for D1, D2 and D3.

Thickness of the partition wall 2 is was set to 102.5 $\mu$m for the thickness A of the partition wall 2 located between red and green, 57.5 $\mu$m for the thickness B of the partition wall 2 located between green and blue, and 25 $\mu$m for the thickness C of the partition wall 2 located between blue and red.

Fluorescent substance pastes of R, G and B colors are applied between the partition walls 2 by screen printing process, thereby forming the fluorescent substances 4 by firing. The front plate 6 with discharge electrode 7 formed thereon was attached to this assembly which was then filled with the rare gas.

The plasma display device which was made as described above was capable of illuminating in white color when emitting over the entire surface, with no yellowish fluorescent being observed. Deviation in the luminance among the fluorescent substances was mitigated, thus achieving full-color plasma display device of high image quality with high color purity.

EXAMPLE 2

Similarly to the example 1, the values of luminance of the individual fluorescent substances were measured, with the luminance data being used to determine the widths of the light emitting cells 5 of the fluorescent substances as 325 $\mu$m for D1 (red), 250 $\mu$m for D2 (green) and 430 $\mu$m for D3 (blue), so that the product of the luminance of the individual fluorescent substance and the cube-of the light emitting cell width is substantially constant.

The die was designed using the calculated value of the light emitting cell width as the base, and the plasma display device shown in FIG. 2 was made as described below. The back plate made of soda-lime glass measuring 2 mm in thickness and 30 inches in diagonal size was coated with an electrode paste including silver as a major component by thick film printing method in the form of stripes 90 $\mu$m in width in order to form the address electrode 3. In this example, stripes were formed at a pitch of P1=315 $\mu$m between red and green, P2=365 $\mu$m between green and blue and P3=400 $\mu$m between green and red over the entire surface and fired, thereby forming the address electrode 3. Through alignment of these electrodes 3, the partition walls 2 were formed as shown in FIG. 2, thereby making the spaces of the light emitting cells. Thickness of the partition walls 2 was set to 25 $\mu$m, the same for A, B and C.

Fluorescent substance pastes of R, G and B colors are applied to the light emitting cells located between the partition walls 2 by screen printing process, thereby forming the fluorescent substances 4 by firing. The front plate 6 with the discharge electrode 7 formed thereon was attached to this assembly which was then filled with the rare gas.

The plasma display device made as described above was capable of illuminating in completely white color when emitting over the entire surface, with no yellowish fluorescent being observed. Deviation in luminance among the fluorescent substance layers 4 was mitigated, thus achieving full-color plasma display device of high image quality with high color purity.

The plasma display device of the present invention is, by changing the sizes of the light emitting cell spaces formed between the partition walls according to the kinds of the fluorescent substance, capable of mitigating the deviation in the luminance among the fluorescent substances and achieving full-color display of high image quality with high color purity.

What is claimed is:

1. A plasma display device illuminating in three primary colors comprising, an insulating back plate as a substrate, a plurality of partition walls on the insulating back plate, the partition walls being substantially parallel to one another and defining light emitting cells;

a transparent front plate mounted on the partition walls, fluorescent substance layers for the three primary colors on the partition walls in the light emitting cells, wherein a light emitting cell having a fluorescent substance layer for one primary color is adjacent to light emitting cells having fluorescent substance layers for the remaining two primary colors;

discharge electrodes in each cell which are attached on the rear side of the transparent front plate, and rare gas filled in all the light emitting cells, and wherein sizes of the light emitting cells of the three primary colors are made different according to a luminance of the fluorescent substance of the corresponding primary color, thereby making the maximum luminance on the display image substantially equal among the three primary colors.

2. The plasma display device according to claim 1, wherein a space of the light emitting cell is formed to be smaller as the luminance of the individual fluorescent substance in the light emitting cell is higher.

3. The plasma display device according to claim 1, wherein a product of the cube of the size of opening of the light emitting cell of one primary color multiplied by the luminance per unit area of the fluorescent substance is substantially equal to that of any other primary color.

4. The plasma display device according to claim 1, wherein size of a space of each cell is set by changing a ratio of pitches of the different color light emitting cells and/or ratio of thicknesses of the partition walls between the different color light emitting cells.

5. The plasma display device according to claim 1, wherein size of the light emitting cell for each primary color is set by changing a ratio of the depths of the different color light emitting cells.

6. The plasma display device according to claim 1, wherein the thickness of the partition wall is formed to be smaller as the sum of the widths of the two light emitting cells located on both sides of the partition wall is smaller.

7. The plasma display device according to claim 1, wherein a ratio of the thickness of the partition wall to the sum of the widths of the two light emitting cells located on both sides of the partition wall is set to be substantially constant for every partition wall.

* * * * *